US005177051A

United States Patent [19]

Hobson et al.

[11] Patent Number: 5,177,051

[45] Date of Patent: Jan. 5, 1993

[54] PRESSURE-SENSITIVE COPYING PAPER

[75] Inventors: Michael E. Hobson, Waterloo; Susan C. Tilbury, Genese, both of Belgium

[73] Assignee: The Wiggins Teape Group Limited, Basingstoke, England

[21] Appl. No.: 803,971

[22] Filed: Dec. 9, 1991

[30] Foreign Application Priority Data

Dec. 15, 1990 [GB] United Kingdom ..... 9027228
Aug. 24, 1991 [GB] United Kingdom ..... 9118311

[51] Int. Cl.[5] ..... B41M 5/165

[52] U.S. Cl. ..... 503/209; 503/200; 503/215; 503/225

[58] Field of Search ..... 503/207, 209, 215, 200, 503/225

[56] References Cited

U.S. PATENT DOCUMENTS 4,762,868 8/1988 Wright ..... 524/17

FOREIGN PATENT DOCUMENTS 0144438 6/1985 European Pat. Off. .
0149557 7/1985 European Pat. Off. .
0223428 5/1987 European Pat. Off. .
0274886 7/1988 European Pat. Off. .
2404533 4/1979 France .
1483479 8/1977 United Kingdom .
2009810 6/1979 United Kingdom .

OTHER PUBLICATIONS

Casey, *Pulp and Paper, Chemistry and Chemical Technology*, 3d Ed., vol. IV, (John Wiley & Sons, 1983).

*Primary Examiner*—Pamela R. Schwartz
*Attorney, Agent, or Firm*—Burns, Doane, Swecker & Mathis

[57] ABSTRACT

An extracted and isolated soy protein polymer is used for prevention of premature coloration in CFB pressure-sensitive copying paper which is neutral- or alkaline-sized with an alkyl ketene dimer and which utilizes an acid clay color developer composition. The soy protein polymer may be carried by the base paper, e.g. as a result of size press or size bath application, or may be present in the microcapsule coating.

2 Claims, No Drawings

PRESSURE-SENSITIVE COPYING PAPER

This invention relates to pressure-sensitive copying paper, also known as carbonless copying paper.

Pressure-sensitive copying paper sets may be of various types. The commonest, known as the transfer type, comprises an upper sheet (usually referred to as a CB or coated back sheet), coated on its lower surface with microcapsules containing a solution in an oil solvent of at least one chromogenic material and a lower sheet (usually referred to as a CF or coated front sheet) coated on its upper surface with a colour developer composition. If more than one copy is required, one or more intermediate sheets (usually referred to as CFB or coated front and back sheets) are provided, each of which is coated on its lower surface with microcapsules and on its upper surface with colour developer composition. Pressure exerted on the sheets by writing, typing or other imaging pressure ruptures the microcapsules, thereby releasing chromogenic material solution onto the colour developer composition and giving rise to a chemical reaction which develops the colour of the chromogenic material and so produces an image.

The present invention is particularly concerned with pressure-sensitive copying paper of the CFB type. A potential problem with such paper is that any free chromogenic material solution in the microcapsule coating may migrate through the paper into contact with the colour developer coating, with the result that premature colouration occurs. The presence of free chromogenic material is almost inevitable, firstly because a small proportion of chromogenic material is always left unencapsulated at the conclusion of the microencapsulation process, and secondly because a small proportion of the microcapsules rupture prematurely during processing of the paper (coating, drying reeling etc.) or on handling or storage of the paper.

We have observed that the above-described problem of premature colouration, which becomes worse when the paper is under conditions of high temperature and/or humidity, is generally significant only when the base paper is neutral- or alkaline-sized with an alkyl ketene dimer size and when the colour developer used is an acid clay, for example an acid-washed dioctahedral montmorillonite clay. Alkyl ketene dimer neutral or alkaline sizing is very well-known in the paper industry (see for example Chapter 2 of "The Sizing of Paper", second edition, published in 1989 by TAPPI Press) and does not therefore require further description.

The reasons why the problem of premature colouration is significant only when the base paper is neutral- or alkaline-sized with an alkyl ketene dimer size and when the colour developer is an acid clay have not been fully elucidated.

We have found that the above-described problem of premature colouration can be significantly reduced if the alkyl ketene dimer neutral- or alkaline-sized base paper is treated with a solution of an extracted and isolated soy protein polymer prior to application of the acid clay colour developer and microcapsule coatings, or if an extracted and isolated soy protein polymer is present in the microcapsule coating. These two solutions to the problem can of course also be combined, i.e. alkyl ketene dimer neutral- or alkaline-sized base paper is treated with an extracted and isolated soy protein polymer, after which a microcapsule composition containing extracted and isolated soy protein polymer is applied to the thus pre-treated base paper. Prior to the application of the microcapsule composition, the pre-treated base paper is coated with acid clay colour developer composition on its surface opposite to that to which the microcapsule composition is applied.

The use of soy protein or other soybean derivatives in pressure-sensitive copying paper has previously been proposed, but none of these proposals are the same as the present invention.

U.S. Pat. No. 4762868 discloses the use of a carboxylated soybean protein in a colour developer composition comprising a phenolic resin or a melamine formaldehyde as the active colour developing ingredient, a pigment such as kaolin and/or calcium carbonate, a defoamer and, optionally a modified starch and a coating lubricant. Use of extracted and isolated soybean protein in such a colour developer composition is clearly different from use of extracted and isolated soybean protein for base paper pre-treatment or in a microcapsule composition to be applied to the surface of the base paper opposite to that to which an acid clay colour developer composition is applied.

British Patent No. 1483479 relates to the use of a desensitizing agent for preventing undesired colour development in pressure-sensitive copying paper. A substantial number of suitable desensitizing agents are disclosed, including vegetable oils such as soybean oil. As discussed in more detail below, soybean oil is different from soy protein polymer.

European Patent Application No. 144438A discloses the use of a defatted soybean powder as a so-called stilt material, i.e. a particulate material for preventing premature microcapsule rupture. Whilst defatted soybean powder contains a proportion of soy protein polymer, the soybean protein is not present in extracted and isolated form as required by the present invention.

Soybeans contain about 40% protein, 20% oil, 18% fibrous polysaccharide, 14% soluble carbohydrate (sugar), and 8% hulls. In the initial stage of commercial processing, the hulls and the oil are typically removed by pressing and mechanical separation, to leave flaky soybean meal. The soybean meal then typically undergoes alkaline aqueous extraction. The resulting extract contains soy protein and soluble low molecular weight sugars. The protein may readily be isolated, and, if desired, may be subjected to chemical modification, for example carboxylation or hydrolysation.

It will be clear from the above that soybean oil, as disclosed in British Patent No. 1483479, is not the same as soybean protein.

Defatted soybean powder is described in European Patent Application No. 144438A as being obtained from raw soybean from which fatty matters have been removed by expression or solvent extraction. This raw soybean residue is further extracted with an alcohol to leave the "defatted soybean powder" which contains only 45 to 55% protein. There is no further extraction or isolation of protein from this powder, and the powder is necessarily used in the microcapsule coating in solid particulate form, as otherwise, it would not fulfil its function as a stilt material. In contrast, the extracted and isolated soy protein used in the present invention is not used in particulate form. Thus the disclosure of European Patent Application No. 144438A is clearly distinguished from the present invention.

In its broadest aspect, the present invention resides in the use of an extracted and isolated soy protein polymer for preventing or reducing premature colouration of pressure-sensitive copying paper comprising base paper neutral- or alkaline-sized with an alkyl ketene dimer and carrying on one surface a coating of pressure-rupturable microcapsules containing an oil solution of chromogenic material and on the other surface a coating of an acid clay colour developer composition.

More particularly the present invention provides pressure-sensitive copying paper comprising base paper neutral- or alkaline-sized with an alkyl ketene dimer and carrying on one surface a coating of pressure-rupturable microcapsules containing an oil solution of chromogenic material and on the other surface a coating of an acid clay colour developer composition, characterized in that an extracted and isolated soy protein polymer is carried by the base paper and/or is present in the microcapsule coating.

A variety of extracted and isolated soy protein polymers are commercially available, for example from Protein Technologies International of St. Louis, Miss., USA and Zaventem, Belgium (Protein Technologies International is a subsidiary of Ralston Purina Company). Most of these commercially available materials are chemically modified, for example hydrolysed by alkaline treatment or carboxylated. Native film-forming soy protein polymers are also available, and these are substantially unmodified. We have found that extracted and isolated soy protein polymers which have been chemically modified, particularly carboxylated soy protein polymers, are best at preventing premature colouration as described above, but that unmodified extracted and isolated soy protein polymers nevertheless provide significant benefits.

When the base paper carries an extracted and isolated soy protein polymer, application of the polymer to the paper is conveniently carried out at a size press or size bath on the papermachine on which the paper is produced.

Whilst a size press or size bath is a particularly convenient and economical means of applying the treating polymer, other treatment methods are in principle usable, for example spraying, passage through an impregnating bath, coating by any of the methods conventional in the paper industry, or application by a printing technique.

Surprisingly, we have observed that no comparable benefit appears to be obtained by treatment of base paper with a number of other polymers as conventionally used for base paper treatment, namely carboxymethylcellulose, gelatin, sodium polyphosphate and various neutral or charged starches such as oxidised potato starch, oxidised maize starch or cationically-modified maize starch.

Apart from the presence of the extracted and isolated soy protein polymer, the present pressure-sensitive copying paper may be conventional. Such paper is very widely disclosed in the patent and other literature, and so will not be discussed extensively herein. By way of example, however:

(i) the microcapsules may be produced by coacervation of gelatin and one or more other polymers, e.g. as described in U.S. Pat. Nos. 2800457; 2800458; or 3041289; or by in situ polymerisation of polymer precursor material, e.g. as described in U.S. Pat. Nos. 4001140; and 4105823;

(ii) the chromogenic materials used in the microcapsules may be phthalide derivatives, such as 3,3-bis(4-dimethylaminophenyl)-6-dimethylaminophthalide (CVL) and 3,3-bis(1-octyl-2-methylindol-3-yl)phthalide, or fluoran derivatives, such as 2'-anilino-6'-diethylamino-3'-methylfluoran, 6'-dimethylamino-2'-(N-ethyl-N-phenylamino-4'-methylfluoran), and 3'-chloro-6'-cyclophexylaminofluoran;

(iii) the solvents used to dissolve the chromogenic materials may be partially hydrogenated terphenyls, alkyl naphthalenes, diarylmethane derivatives, dibenzyl benzene derivatives, alkyl benzenes and biphenyl derivatives, optionally mixed with diluents or extenders such as kerosene.

The acid clay colour developer material utilised in the present pressure-sensitive copying material is typically an acid-washed dioctahedral montmorillonite clay, e.g. as described in U.S. Pat. No. 3753761. Such clays are widely used as colour developers for pressure-sensitive copying papers, and so need no further description.

The thickness and grammage of the base paper may also be conventional, for example the thickness may be in the range 60 to 90 microns and the grammage in the range 35 to 90 g $m^{-2}$.

The invention will now be illustrated by the following Examples, in which all percentages are by weight:

EXAMPLE 1

A standard 49 g $m^{-2}$ alkaline-sized carbonless base paper having an approximately 14% calcium carbonate filler content and a 3.5% alkylketene dimer size content, and which had previously been conventionally surface sized with starch, was size-press coated on a pilot plant coater with a 2% solution of an extracted and isolated carboxylated soy protein polymer ("RXP 52505" supplied by Protein Technologies International and believed now to have now been re-designated "Pro-Cote 5000"—"Pro-Cote" is a trade mark). The dry pick-up of soy protein polymer was 1.3 g $m^{-2}$.

The resulting treated paper and an untreated sample of the same base paper were then laboratory coated with a conventional colour developer formulation at a coatweight of 7.5 g $m^{-2}$. The colour developer formulation contained acid-washed montmorillonite clay (70%), kaolin (15%) and calcium carbonate (15%), and a conventional styrenebutadiene latex binder. The resulting papers were then coated on their opposite surfaces with a conventional gelatin coacervate microcapsule composition as conventionally used in the production of carbonless copying paper at a coatweight of 5 g $m^{-2}$. The encapsulated chromogenic composition used a conventional three component solvent blend (partially hydrogenated terphenyls/alkyl naphthalenes/kerosene) and contained crystal violet lactone and other conventional chromogenic materials.

The resulting CFB papers were stored for 5 days in a climatic oven at 32° C. and 90% relative humidity (RH). It was observed that the CFB paper derived from the untreated base paper showed significant blue discolouration, whereas the soy protein-treated base paper did not. After a further five days storage under the same conditions, the discolouration of the untreated paper was considerably worse, whereas the treated paper still showed no significant discolouration. The reflectance values of the papers were monitored, as compared to a white standard, and were as follows (the higher the reflectance, the less the discolouration):

| | Initial Reflectance (%) | Reflectance After 5 days (%) | Reflectance After 10 days (%) |
|---|---|---|---|
| Untreated | 83 | 78 | 66 |
| Treated | 83 | 83 | 82 |

The procedure was then repeated with various other polymers, namely carboxymethylcellulose, gelatin, sodium polyphosphate, oxidised maize starch, oxidised potato starch, and cationically-modified maize starch. None of these were effective in preventing significant blue discolouration, although gelatin (also a protein) was more effective than the other materials tried.

EXAMPLE 2

A 4% solution of a carboxylated extracted and isolated soy protein polymer ("RXP 52505") was made up. This solution also contained ammonium hydroxide as a solubilizing agent and an antifoaming agent, at levels of 15% and 1.5%, based in each case on the weight of soy protein polymer used. This solution was used as a master batch for further dilution before being supplied to the size press of a production-scale papermachine. Two different size press mixes were used, having soy protein concentrations of 2% and 1% respectively. The pick-up from the size press was such that the dry coatweight of soy protein polymer was about 0.6 g $m^{-2}$ for the 2% concentration mix and 0.3 g $m^{-2}$ for the 1% concentration mix (total of coating on both surfaces of the paper in each case). The papermachine was fitted with an on-machine trailing-blade coater, which applied a conventional colour developer formulation as described in Example 1 at a coatweight of about 7 g $m^{-2}$, so as to give a 46 g $m^{-2}$ colour developer paper.

A proportion of the colour developer paper was then coated on its surface opposite the colour developer coating with a microcapsule coating in a separate off-machine coating operation. The microcapsules in this coating composition were as described in Example 1.

The resulting CFB paper was tested as described in Example 1 (5 days climatic oven exposure only), using a conventional starch-sized paper (c. 0.6 g $m^{-2}$ starch) as a control. Apart from the nature of the composition applied at the size press, the control paper was similar to the paper according to the invention. The results of this testing were as follows:

| | Initial Reflectance (%) | Reflectance After 5 days (%) |
|---|---|---|
| Invention (2% mix) | 83 | 82.8 |
| Invention (1% mix) | 83 | 82.8 |
| Control | 83 | 78 |

It will be seen from the above data that soy protein treatment was effective in preventing discolouration, whereas the conventional starch-sized paper did discolour (this discolouration was apparent not just on the basis of the instrumental readings, but also to the naked eye).

EXAMPLE 3

This illustrates the use of a carboxylated extracted and isolated soy protein polymer as a binder in the microcapsule coating composition of a CFB paper.

Two microcapsule batches were made up at a solids content of 24% from microcapsules (c. 66% on a dry weight basis), ground cellulose fibre floc as a stilt material (c. 20% on a dry weight basis) and a binder (c. 14% on a dry weight basis). In one case the binder was according to the invention ("Pro-Cote 5000" carboxylated soy protein polymer supplied by Protein Technologies International and in the other case the binder was a conventional gelatinized starch binder, to provide a control.

The microcapsule batches were separately coated on to the uncoated surface of a conventional CF paper at the same 5 to 6 g $m^{-2}$ target dry coatweight in each case by means of a pilot-scale metering roll coater. The active ingredient of the colour developer composition was an acid-washed dioctahedral montmorillonite clay. The colour developer coatweight was about 7 g $m^{-2}$ and the grammage of the CF paper before microcapsule coating was about 46 g $m^2$. The base paper had been neutral sized with a conventional alkyl ketene dimer size. The microcapsules were as described in Example 1.

Samples of the resulting microcapsule papers were stored in a climatic oven for 5 days at 32° C. and 90% RH. It was observed that whereas there was no significant discolouration for the paper according to the invention, the control paper showed substantial discolouration. The mean reflectance values, obtained as described in Example 1, were as follows:

| | Initial Reflectance (%) | Reflectance After 5 days (%) |
|---|---|---|
| Control | 82 | 78 |
| Invention | 83 | 81 |

The papers were also tested for imaging performance in a pressure-sensitive copying set and both were found satisfactory.

EXAMPLE 4

This illustrates the inclusion of a proportion of carboxylated extracted and isolated soy protein polymer in a conventional gelatinized starch binder in the microcapsule coating composition of a CFB paper.

The procedure was as described in Example 3, except that three microcapsule batches were made up. One was a control batch using gelatinized starch binder, and the other two were according to the invention, with carboxylated extracted and isolated soy protein polymer ("Pro-Cote 5000") being used as a partial replacement for the gelatinized starch, at levels of 10% and 20% respectively, based on the total weight of starch and carboxylated soy protein polymer.

It was observed that after 5 days storage in a climatic oven at 32° C. and 90% RH, neither of the papers incorporating a proportion of soy protein polymer showed significant discolouration, whereas the control paper showed a distinct blue discolouration. The mean reflectance values, measured as before, were as follows:

| | Initial Reflectance (%) | Reflectance After 5 days (%) |
|---|---|---|
| Control | 83 | 77 |
| Invention (10% soy) | 83 | 81 |

-continued

| | Initial Reflectance (%) | Reflectance After 5 days (%) |
|---|---|---|
| Invention (20% soy) | 83 | 82 |

The papers were also tested for imaging performance in a pressure-sensitive copying set, and all were found satisfactory.

EXAMPLE 5

This further illustrates the inclusion of a proportion of carboxylated extracted and isolated soy protein polymer in a conventional gelatinized starch binder in the microcapsule coating of a CFB paper, but with a smaller proportion of carboxylated soy protein polymer than in Example 2.

The procedure was as described in Example 4, except that five microcapsule batches were made up, one being a gelatinized starch control and the others containing carboxylated extracted and isolated soy protein polymer ("Pro-Cote 5000") as a partial replacement for the gelatinized starch at levels of 2.5%, 5.0%, 7.5% and 10%, based on the total weight of starch and carboxylated soy protein.

It was observed that after 5 days storage in a climatic oven at 32° C. and 90% RH, none of the papers incorporating a proportion of carboxylated soy protein polymer showed any significant discolouration, whereas the control paper showed a slight but noticeable pale blue discolouration. After a further 5 days storage under the same conditions, the discolouration of the control paper had increased significantly, and a very slight blue discolouration had developed on the papers incorporating the lowest levels of carboxylated soy protein polymer (2.5% and 5.0%). There was still no discolouration observable in the papers incorporating carboxylated soy protein polymer at the higher levels (7.5% and 10.0%). The reflectance values, measured as before, were as follows:

| | Initial Reflectance (%) | Reflectance After 5 days (%) | Reflectance After 10 Days (%) |
|---|---|---|---|
| Control | 83 | 78 | 76 |
| Invention (2.5% soy) | 82 | 81 | 79 |
| Invention (5.0% soy) | 82 | 81 | 80 |
| Invention (7.5% soy) | 82 | 81 | 80 |
| Invention (10% soy) | 83 | 82 | 80 |

The papers were also tested for imaging performance in a pressure-sensitive copying set, and all were found satisfactory.

EXAMPLE 6

This illustrates the use of a range of different extracted and isolated soy protein polymers, as follows:

a) natural polymer extracted and isolated from soybeans and chemo-thermally modified under alkaline conditions to produce a hydrolysed product ("Pro-Cote" 150).

b) natural polymer of the same general description as for (a) above ("Pro-Cote" 200)

c) modified polymer extracted and isolated from soybeans and chemically modified to provide a high anionic charge ("Pro-Cote" 240).

d) carboxylated soy protein polymer ("Pro-Cote" 400)

e) carboxylated soy protein polymer ("SP" 2500)

All the above soy protein polymers are supplied by Protein Technologies International (as previously indicated, "ProCote" is a trade mark).

The various soy protein polymers were each separately evaluated on a laboratory scale by incorporation in a microcapsule composition as follows:

| | |
|---|---|
| microcapsules (as described in earlier Examples) | 66.7% (dry) |
| cellulose fiber floc (stilt material) | 20.7% (dry) |
| soy protein polymer | 12.6% (dry) |

In addition, a control composition was also evaluated, this being as described above except that a conventional gelatinized starch binder was used in place of soy protein polymer.

Colour developer papers were first produced by laboratory coating as described in Example 1 except that no soy protein polymer coating was applied. Each microcapsule composition was coated on to the uncoated surface of this colour developer paper at a target coat-weight of c. 5 g $m^{-2}$.

The resulting CFB papers were stored in a climatic oven at 32° C. and 90% RH for 5 days and then assessed for discolouration. The control sheet exhibited marked discolouration, but the soy protein sheets all showed significantly less discolouration. No significant difference in discolouration level was observed as between the different soy protein samples. the reflectance values, measured as before, were as follows:

| | Initial Reflectance (%) | Reflectance After 5 days (%) |
|---|---|---|
| Control | 82 | 76 |
| Invention (a) | 83 | 79 |
| Invention (b) | 83 | 79 |
| Invention (c) | 82 | 79 |
| Invention (d) | 83 | 79 |
| Invention (e) | 83 | 79 |

The papers were also tested for imaging performance in a pressure-sensitive copying set, and all were found satisfactory.

EXAMPLE 7

This illustrates the use of a variety of different extracted and isolated soy protein polymers for treating base paper prior to coating with colour developer and microcapsule compositions.

The soy protein polymers, all supplied by Protein Technologies International, were as follows:

a) natural polymer extracted and isolated from soybeans, which while modified in some respects, maintains a near native protein structure ("SP" 9001).

b) hydrolysed natural polymer as in (b) of Example 6 4 above ("Pro-Cote" 200)

c) carboxylated soy protein polymer as in (d) of Example 6 above ("Pro-Cote" 400)

7.5% aqueous solutions of the above soy protein polymers were prepared by adjusting the pH to 9.5 with ammonium hydroxide and heating gently to 40° C. Each solution was then applied to sheets of base paper as described in Example 1 by means of a laboratory rod coater, and dried for 15 seconds. Subsequent measurements showed that the dry coatweights (g $m^{-2}$) obtained were as follows:

| | |
|---|---|
| polymer (a) | 0.07 |
| polymer (b) | 0.43 |
| polymer (c) | 0.75 |

The disparity in coatweights applied was due to the differing soy protein polymer viscosities, which affected solution solids and hence wet coatweights metered on by the laboratory coater.

A colour developer composition as described in Example 1 was then applied to the treated papers at a target coatweight of c. 7.5 g $m^{-2}$. Two samples of each soy protein polymer treated paper were taken in each case. In one case, the colour developer composition was applied to the surface of the test paper to which the soy protein polymer had been applied, and in the other case to the opposite surface. This was to allow for the possibility that the soy protein polymer solution had not become evenly distributed through the paper.

Colour developer composition was also coated on to base paper which had not been treated with soy protein polymer, in order to provide a control.

After drying, the sheets were then laboratory coated with a microcapsule composition as described in Example 1, dried, and stored in a climatic oven at 32° C and 90% RH for 5 days. The extent of discolouration was assessed both visually and by reflectance values.

It was observed that the control paper gave the highest level of discolouration. Soy protein polymer (a) gave slight discolouration (regardless of the surfaces of the paper to which the coatings had been applied). Soy protein polymers (b) and (c) gave no discolouration at all. In considering the slight discolouration observed with polymer (a), it must be remembered that the coatweight present was very low compared with that for polymers (b) and (c). The reflectance values, measured as before were as follows:

| | Initial Reflectance (%) | Reflectance After 5 days (%) |
|---|---|---|
| Control | 82 | 80 |
| Invention (a) - same surface | 81 | 80 |
| Invention (a) - opposite surface | 84 | 82 |
| Invention (b) - same surface | 83 | 83 |
| Invention (b) - opposite surface | 83 | 83 |
| Invention (c) - same surface | 84 | 83 |
| Invention (c) - opposite surface | 84 | 83 |

We claim:

1. Pressure-sensitive copying paper comprising base paper neutral- or alkaline-sized with an alkyl ketene dimer and carrying on one surface a coating of pressure-rupturable microcapsules containing an oil solution of chromogenic material and on the other surface a coating of an acid clay colour developer composition, characterized in that an extracted and isolated non-particulate soy protein polymer is carried by the base paper and/or is present in the microcapsule coating.

2. Pressure-sensitive copying paper as claimed in claim 1, wherein the soy protein polymer is chemically modified carboxylation or hydrolyzation.

* * * * *